United States Patent [19]

Bouette

[11] 4,334,002

[45] Jun. 8, 1982

[54] IMAGE DEVELOPMENT METHOD

[75] Inventor: Rodger D. Bouette, Somerville, Australia

[73] Assignee: Repco Research Pty. Ltd., Dandenong, Australia

[21] Appl. No.: 917,366

[22] Filed: Jun. 20, 1978

Related U.S. Application Data

[63] Continuation of Ser. No. 691,607, Jun. 1, 1976, abandoned.

[30] Foreign Application Priority Data

Jun. 4, 1975 [AU] Australia ..... PC 1864

[51] Int. Cl.[3] ..... G03G 13/10; G03G 13/22

[52] U.S. Cl. ..... 430/103; 430/119

[58] Field of Search ..... 96/1 R, 1 LY, 1.3; 427/15, 16; 430/103, 119

[56] References Cited

U.S. PATENT DOCUMENTS

| | | | |
|---|---|---|---|
| 3,071,645 | 1/1963 | McNaney | 96/15 D |
| 3,729,334 | 4/1973 | Snelling | 96/1 R X |
| 3,850,627 | 11/1974 | Wells et al. | 96/1.3 |
| 3,901,696 | 8/1975 | Mohn et al. | 96/1 R X |
| 3,941,593 | 3/1976 | Butement | 96/1 R X |

*Primary Examiner*—Roland E. Martin, Jr.

*Attorney, Agent, or Firm*—Dennison, Meserole, Pollack & Scheiner

[57] ABSTRACT

An electric field is established in the gap between an imaging surface and an opposing electrode surface inducing movement of particles from suspension within a developer in the gap toward the opposing electrode surface. A voltage pattern generated on the imaging surface causes deposit of the developer particles in image relation on the opposing electrode surface or on a printing surface positioned adjacent thereto, by a repulsive action between the imaging surface and the particles having an electrostatic charge of the same polarity.

9 Claims, 11 Drawing Figures

IMAGE DEVELOPMENT METHOD

This is a continuation of application Ser. No. 691,607, filed June 1, 1976 now abandoned.

This invention relates to a method of developing a visible image on a surface by using the electric fields associated with voltage patterns present on an adjacent surface.

Normally in the production of such visible images developer particles of opposite polarity to that of the electric field pattern are attracted towards the surface on which the electric field pattern exists. These particles are then either fixed directly to this surface or are subsequently transferred to a second surface where fixation takes place. Major application of this development process is in electrostatic photocopying, and numerous machines exist where copy images are developed on the photoconductor, such as the zinc oxide electrofax machines, or alternatively undergo a transfer stage to plain paper such as in the Selenium drum machines used in xerographic processes.

The significant disadvantage in the electrofax method is the weight of the zinc oxide paper whereas in the transfer machines the associated wear of the photoconductive surface during transfer and subsequent cleaning is a limiting factor in its useful life.

The above disadvantages including the transfer and cleaning of particles from the photoconductive imaging surface are overcome in the present invention by causing the development to take place on a surface adjacent to and not on the surface carrying the electric field image, by repulsion of the image forming pigment particles away from the electric field pattern carrying surface.

One way of achieving the above comprises placing an electrode of neutral or opposite polarity to that of the image generating surface so that a substantially perpendicular electric field is established between the electrode and image generating surface. This arrangement is placed in a bath of developer fluid in which the image forming pigment particles have a polarity such that they are repelled from the field generating surface and are attracted towards the opposite electrode. The particles will then deposit on this electrode in image relation to the voltage pattern present on the field generating surface.

This image may subsequently be transferred to a more suitable surface such as paper and fixed thereto or alternatively the paper itself can form part of the second electrode and the particles can be deposited directly onto its surface.

We have found in practice that the resolution of the repulsed image deteriorates as the two electrodes are moved farther apart and therefore optimum spacing is dependent on the resolution required. For very fine resolution the spacing is required to be as small as practical whereas for coarser images distances up to and over 5 mm can be tolerated.

In the preferred form of the invention described below, the invention is applied to the electrophotographic apparatus and method of U.S. Pat. No. 3,941,593. However, it should be understood that the invention is applicable with equal advantage to other copying methods in which electric field patterns are utilised.

One preferred form of the invention will now be described with reference to the accompanying drawings in which.

Figure 1A:
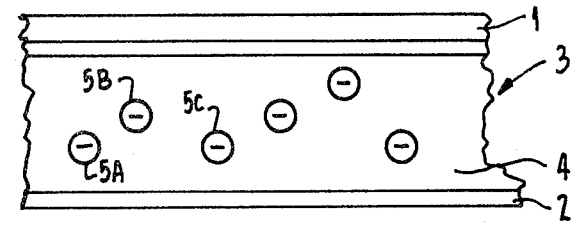
FIGS. 1A to 1D are schematic views of an electrographic image development system operating in accordance with the prior art method.

In FIGS. 1A to 1D, the electrographic plate 1 is of the type described in U.S. Pat. No. 3,941,593 Butement. The image development system includes a parallel opposing electrode 2 spaced from the plate 1 by about 1 mm with both the plate 1 and the electrode 2 immersed in a bath of developer 3 consisting of the carrier liquid 4 having charged pigment particles 5A, 5B, 5C etc. suspended therein. The pigment particles 5 bear a net electrostatic charge when suspended in the carrier liquid 4. The net charge on the particles may be either positive or negative; in this instance a negative charge has been employed.

Figure 1B:
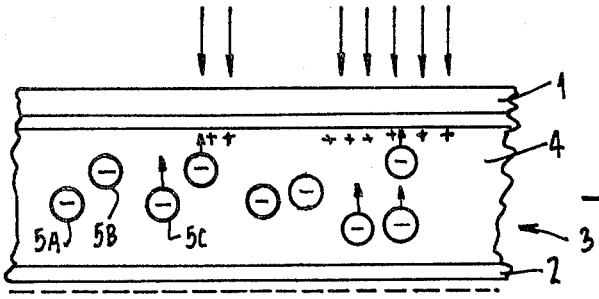
Figure 1C:
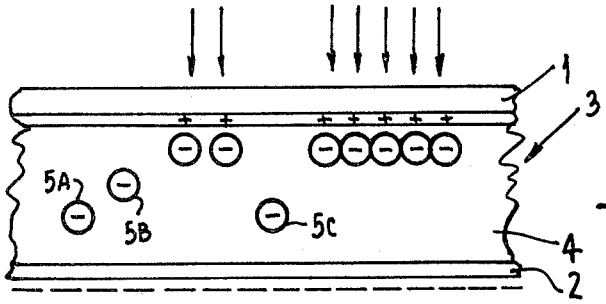

According to the teachings of U.S. Pat. No. 3,941,593 when a light image is projected onto the electrographic plate through its transparent base, as shown in FIG. 1B, certain areas of the surface of the plate derive a voltage potential, the polarity of which depends on the electrical connections made to the plate. In this instance a positive polarity has been assumed although the opposite polarity may be used. Under these conditions the electric fields set up between the electrographic plate 1 and the opposing electrode 2 cause those particles 5A, 5B etc under their influence to move in the direction of the electrographic plate 1 as shown in FIG. 1B. FIG. 1C shows the affected particles deposited in image relation on the surface of the electrographic plate 1.

Figure 1D:
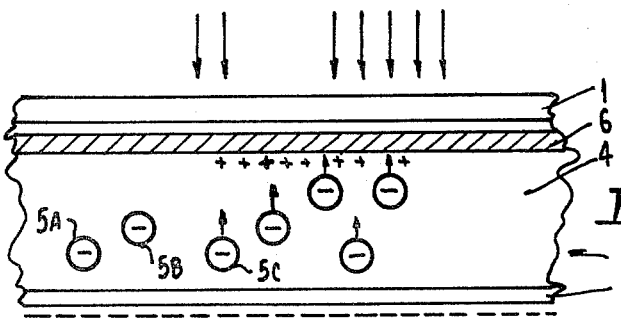

If a sheet of paper 6 (FIG. 1D) is placed over the surface of the electrographic plate 1, as envisaged in the aforementioned patent, and the plate is again illuminated with an image such that positive potentials will still move towards the surface of the paper. However due to the thickness of the paper and its conductivity, caused by the absorption of atmospheric moisture, the resolution of the image deposited on the surface of the paper will be poor. The potentials created on the surface of the paper are shown in FIG. 1D where it can be seen that they have merged into a more or less equipotential area providing little resolution.

Figure 2A:
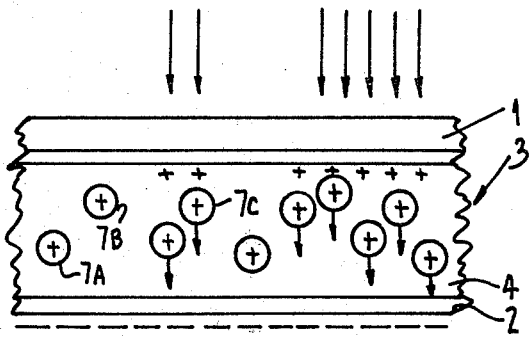
FIGS. 2A to 2C are similar schematic views of an electrographic image development system operating in accordance with the method of the embodiment.

Alternatively, the developer particles are deposited on the plate 1 and then transferred to a paper sheet. This method has the disadvantage that a transfer stage is necessary in order to place them onto paper. Subsequently a cleaning cycle is required to remove excess particles from the surface of the electrophotographic plate. These difficulties are removed by the present invention, the basis of which is shown in FIGS. 2A, B and C. In these diagrams the numerals denote the same elements as contained in FIGS. 1A–D. The essential difference between the method of this invention and that as described above is in the polarity of the pigment particles and the method by which they can be placed onto an adjacent surface including insulating or conducting sheets such as paper without the loss of resolution incurred by the previous techniques.

Figure 2B:
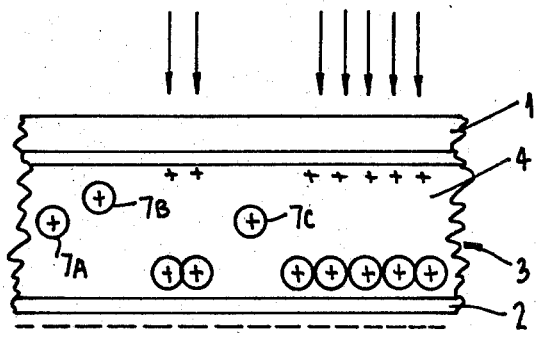

When a light image is projected onto the electrographic plate 1 as in the previous instances, certain areas of the surface of the plate derive a potential which is in image relation. The polarity has once again been chosen as positive. The pigment particles denoted by 7A, 7B, 7C etc. are in this instance positively charged. As shown in FIG. 2A the direction of movement of those particles under the influence of the electric fields associated with the potentials on the plate 1 surface is now towards the opposing plate electrode 2. These particles will deposit on plate 2 in the same image relation, as shown in FIG. 2B.

Figure 2C:
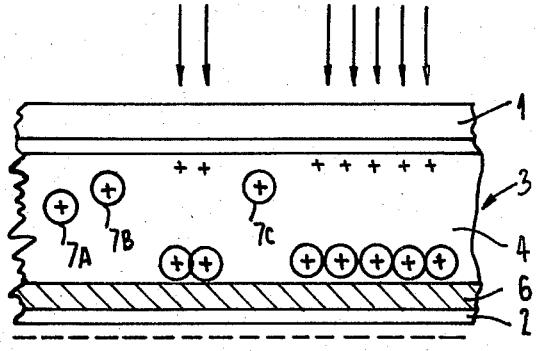

FIG. 2C shows the effect of interposing a sheet of paper 6 between the electrographic plate and its opposing electrode in the manner defined by this invention. It will be noted that deposition has again been achieved in image relation. In this instance the conductivity of the paper is an advantage as by this arrangement it becomes the electrode to which the particles are attracted.

An insulating paper can also be used in this invention providing that the thickness is not so great as to prevent the formation of the substantially perpendicular lines of force between the two plate surfaces.

Any one of the electrographic plates described in the U.S. Patent referred to may be used with the present invention as well as other suitable plates.

Figure 3:
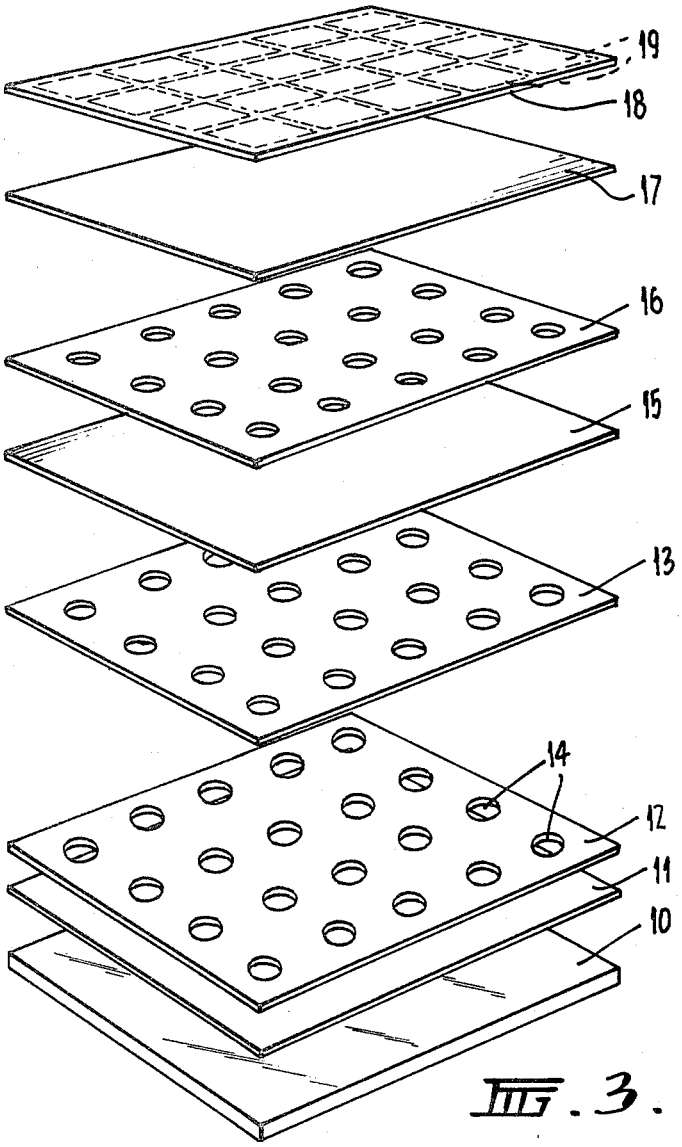
FIG. 3 is an exploded view of an electrographic plate suitable for use in the above development system.
Figure 4:
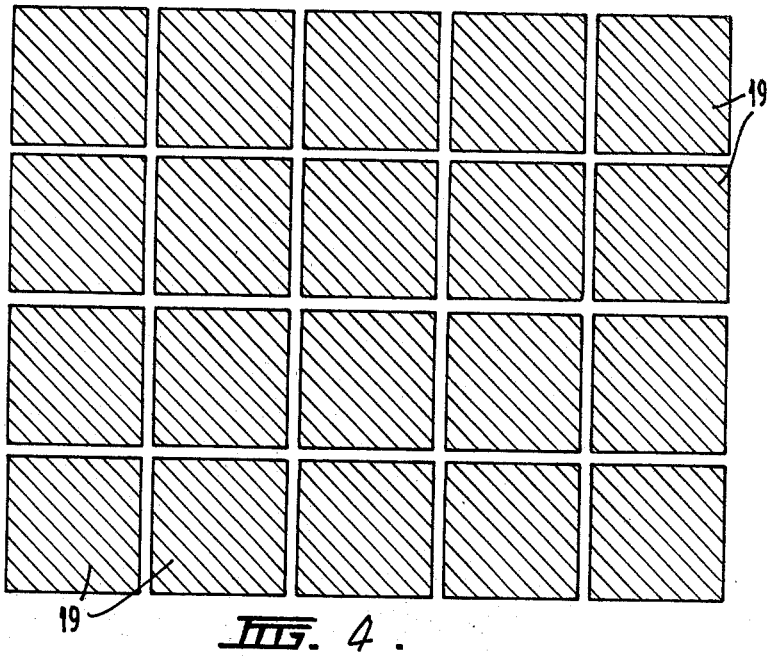
FIG. 4 shows the arrangement of discrete conducting elements on the face of the plate of FIG. 3.
Figure 6:
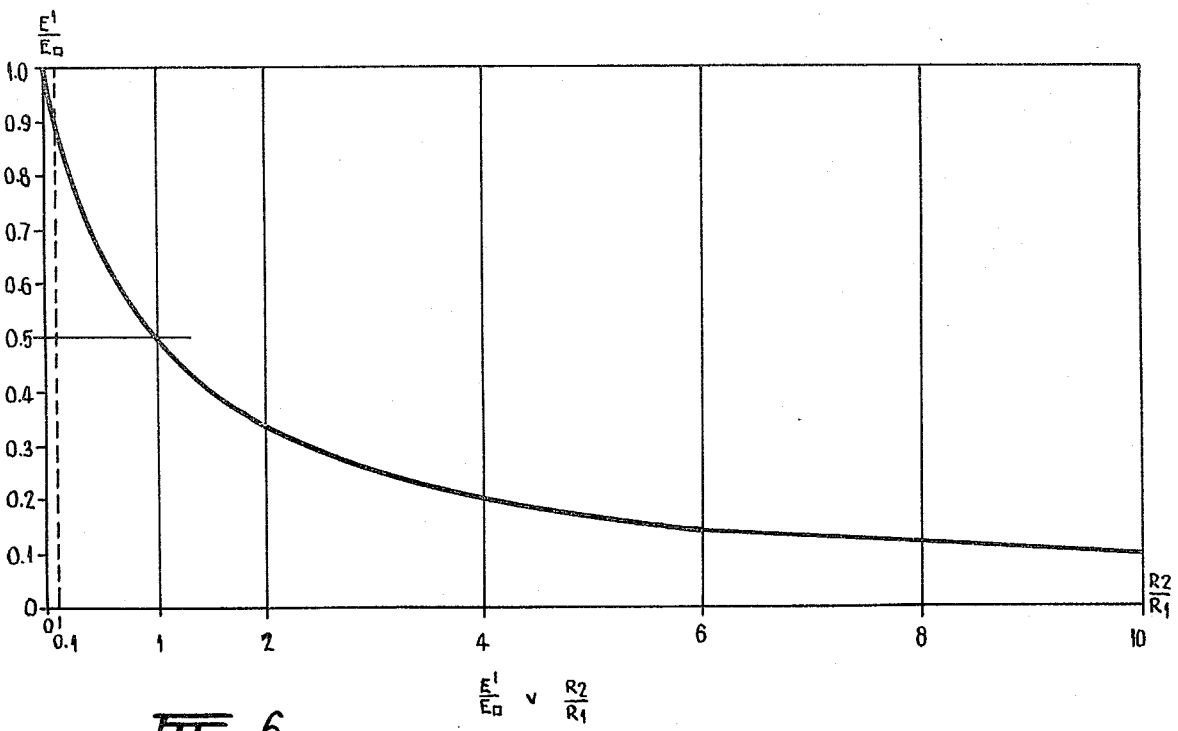
FIG. 6 is a graph used in choosing the value of $R_1$ relative to $R_2$.

A preferred form of plate is shown in FIGS. 3 and 4. This plate is somewhat similar to the plate described in connection with FIGS. 6 to 8 of U.S. Pat. No. 3,941,593 with some refinements and modifications. In common with the earlier form the continuous mesh by means of which the applied voltage is transferred to the discrete areas is located below the surface of the plate so that only the discrete areas are exposed.

Referring now to FIG. 3, there is provided a base sheet of glass or other transparent material 10 upon which there is a layer of optically transparent and electrically conductive material 11 such as tin oxide. This layer is similar to the equivalent layers in the embodiments described in the U.S. patent. An opaque layer of conductive material 12 which can be a metal such as copper or aluminum, is then laid down by well-known vacuum evaporation techniques. A suitable photoresist such as K.P.R. is then spin coated over the surface of the metal and dried. Exposure of the photoresist through a photographic negative followed by development leaves a pattern of holes in the photoresistive layer forming an insulating layer 13. A chemical etchant suitable for the material selected as the opaque conductive layer 12 can be used to remove the metal in the areas of layer 12 not protected by the photoresist, thus forming holes 14 as shown. A photoconductive layer 15 of a material such as Se or a Se/Te alloy is then vacuum evaporated over the surface of the plate and a second conductive layer 16 is laid down over the photoconductive layer. This can also be a vacuum evaporated metallic layer such as copper or aluminium. Another photoresist layer such as Shipley AZ111 is spin coated over the surface. Exposure, development and etching takes place as before and the apertured layer so produced constitutes the continuous conducting mesh of the other embodiments. It will be clear from FIG. 3 that the continuous conducting mesh 16 is insulated from the opaque conductor 12 and hence from the tin oxide layer 11 by the photoconductive material which in the dark acts as an insulator. The opaque layer 12 ensures that the photoconductive layer 15 is always held at a high resistance value in the required areas. A further layer of the same photoconductive material is then vacuum evaporated over the surface of layer 16 to produce layer 17 which is in contact with layer 15 through the holes in layer 16. A third conductive layer 18 is laid over the entire surface of the photoconductive layer and by employing the photoresist and chemical etching techniques as used before the desired pattern of discrete areas 19 shown in FIG. 4 is produced.

In this preferred form each area 18 has 0.009 inch sides with the spacing between adjacent areas being 0.001 inch. The holes 14 in the layers 12, 13 and 16 are arranged centrally of each discrete area 19 so that an element of photoconductor extends from each area 19 to the layer 11. In the above dimensions the holes in layer 12 are about 0.0035 inch in diameter while the holes in layer 16 are about 0.006 inch in diameter.

In order to demonstrate the manner in which each discrete area on the plate surface can derive a potential dependent on the intensity of light incident on the photoconductive layer immediately below it reference is made to the equivalent circuit diagram shown in FIG. 5 wherein:

$E^\circ$ is the potential applied to the plate between layer 11 and mesh 16C denotes the junction point between the tin oxide layer 11 and that portion of the photoconductive layers 15 and 17 immediately below and in electrical contact with a discrete surface area 19

D is the continuous conductive mesh 16

$R_2$ is the resistance of that portion of the photoconductive layers 15 and 17 immediately below and in electrical contact with a discrete area 19

$R_1$ is the resistance between the continuous mesh 16 and the discrete areas 19 (as described further below)

19 is the discrete area being considered $E^1$ is the voltage at 19

2 is the opposing electrode

X Y & Z are tappings on potentiometer M

It can be shown that the voltage $E^1$ incurred at 19 equals $E^\circ R_1/(R_1+R_2)$. The potential $E^1$ varies with the value of resistance $R_2$ and this in accordance with the intensity of the light falling upon the photoconductive layer below the discrete area and to which it is directly connected. If a potential difference exists between opposing electrode 2 and the area 19 such that an electric field is produced, charged particles of pigment will, according to the prior art development method be attracted to the area 19 and this attraction will be dependent upon the strength of the field and thus upon the voltage $E^1$. If in accordance with this invention the charge on the pigment particles is reversed, the particles will be repelled to the reference electrode R in image relation as described more fully above.

To enable the electrographic plate as shown to work satisfactorily a careful matching of the various electrical parameters is essential. As already mentioned, the resistance $R_2$ is produced by the photoconductive layer 15 and 17 and is a measure of the electrical resistance produced between the discrete metal area 19 on the plate surface and the tin oxide covering 11 on the surface of the transparent base 10. The value of this resistance depends on the specific resistivity of the photoconductor, the thickness of the photoconductive layer and the diameter of the hole developed in the photoresist layer. For example, if the material used was selenium/tellurium alloy as detailed by Keck in Journal of the Optical Society of America Vol. 42 No. 4, the specific resistivity in the dark could be $10^{12}$ ohms-cm and in the light $10^{10}$ ohms-cm. In the manufacture of an electrographic plate comprising of one hundred discrete areas/inch the radius of the holes developed in a photoresist layer 0.0002 inches thick can be set at 0.0018 inches. If a plate is manufactured to these specifications the resistance $R_2$ can be calculated using the formula:

$$R_2=\rho(L/A)$$

where $\rho$=specific resistance of Se/Te alloy

L=thickness of the Se/Te photoconductor layer

A=area of hole developed in the photoresist layer.

Using the formula $R_2^{Dark}$ is found to be$=8.22\times10^{12}$ ohms. By substituting the dark specific resistivity of the Se/Te alloy for the value it possesses under light conditions the value of $R_2^{Light}$ can be calculated and found to be approximately $8\times10^{10}$ ohms. To allow the proper selection of $R_1$ as denoted in FIG. 5 a consideration of this circuit diagram is necessary. It can be shown that $$E^1=\frac{E^0}{1+\frac{R_2}{R_1}} \text{ and } \frac{E_1}{E_0}=\frac{1}{1+\frac{R_2}{R_1}}$$

The effect of choice of values of $R_1$ can be conveniently studied by plotting $R_2/R_1$ against $E_1/E_0$. This is set out in Table 1 and FIG. 6 where $R_2/R_1$ is plotted in a linear scale over the order of magnitude on either side of $R_2=R_1$. As can be seen this two order range provides a total voltage change at $E_1$ approximately 80% of the supply voltage. If the non linearity is acceptable then the selection of $R_1$ equal to the logarithmic mean of the light and dark values of $R^2$ would provide maximum output. $R_1$ could be selected to equal either $R_2^{Light}$ or $R_2^{Dark}$ in which case the useful output would be only about 40% of E°. Other values of $R^1$ can also be considered if it is desired to correct any non linearity in the resistance change of the photoconductor material with increases in light intensity.

From the above data it can be seen that the value of $R_1$ can vary over the entire range of values for $R_2$. In the example given this means that the value of $R_1$ can be set at any value between $8\times10^{10}$ ohms and $8\times10^{12}$ ohms depending on the desired result. Once the value of $R_1$ is known the geometry of the overlap between the discrete areas 19 and the underlying mesh 16 can be calculated to satisfy its values.

Figure 5:
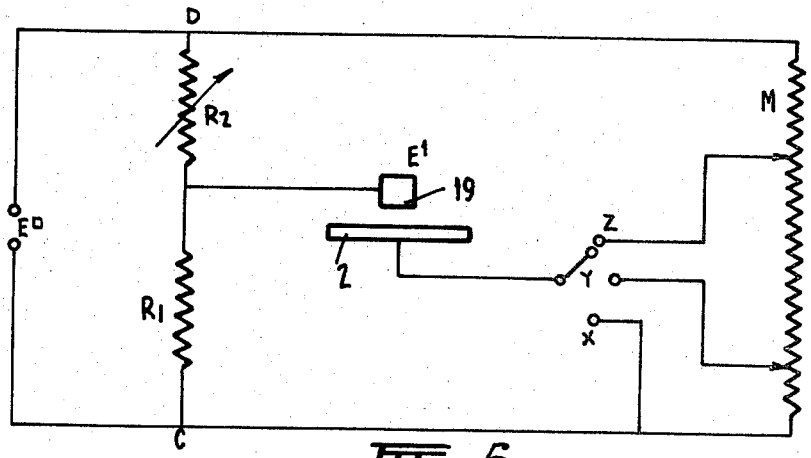
FIG. 5 is an equivalent electrical circuit of the system showing the voltages applied thereto.

Relating FIGS. 3 and 4 to FIG. 5 it can be seen that in this plate the photoconductive layer 17, by virtue of the overlap of the discrete areas 19 on the underlying continuous mesh 16, itself forms the resistance $R_1$. Using the dimensions set out above it can be calculated that the resistance $R_1$ falls with the range of values $R_2^{Light}$ and $R_2^{Dark}$ where $R_2$ is the resistance defined above.

Experiments have been conducted using the plate described above with the following parameters:

| | |
|---|---|
| Grid System voltage (point D FIG. 5) | 0 volts |
| Voltage at conductor layer 11 (point C FIG. 5) | 30 volts |
| Voltage at opposing electrode 2 | 15 volts |
| Spacing between plate 1 and electrode 2 | 0.010 inch |
| Developer | Ozapaper electrostatic toner (positive) |
| Time | 5 secs. |

Satisfactory results were obtained in reproducing type print. The voltages indicated above are typical for this application. By decreasing the spacing between the plate and electrode, the development time decreases and the resolution improves. If the electrode 2 is replaced by a conductive roller in accordance with a plate 1 of the type shown in FIGS. 3 and 4, an applied potential of 5 volts on the roller will produce an image quality comparable to a half tone magazine print. Using this arrangement, a sheet of paper may be interposed between the roller and the plate to directly receive the image or alternatively the image may be taken by the roller and transferred to paper by an offset process. Similar results may be obtained by contacting the electrode 2 and the plate 1 and slowly withdrawing the electrode 2 during exposure.

While the developer has been described as being a liquid carrier, the carrier may be air or another suitable gas and the term fluid is intended to include same.

I claim:

1. A method of electrographically forming a printable image using an electrographic plate having an imaging face closely spaced from an opposing electrode comprising the steps of: applying a voltage to said imaging face and to said opposing electrode producing an electric field extending from said imaging face to said opposing electrode; illuminating said plate with an image to generate a voltage pattern on said face; and passing a developer fluid between the face and said opposing electrode; the improvement comprising entraining a printing medium within said developer fluid to be placed thereby within said electric field in out of contact relation to said face, said printing medium having a net electrostatic charge of the same polarity as the voltage applied to said face which causes migration of the printing medium in image relation to said voltage pattern towards the opposing electrode from the developer fluid under the influence of the electric field.

2. The method of claim 1, comprising the further step of positioning a sheet of paper in contact with the opposing electrode, said printing medium being deposited in image relation on said paper.

3. The method of claim 1, wherein the polarity of the voltage applied to the face is positive and the net electrostatic charge on the printing medium is positive.

4. The method of claim 1, wherein said opposing electrode is in the form of a conductive roller, said roller being rolled over the face to collect said printing medium from said developer fluid.

5. The method of claim 1, wherein said opposing electrode is initially arranged in contact with said face and is subsequently slowly withdrawn from said face to allow the attraction of the printing medium to said electrode in image relation.

6. The method of claim 1, wherein said electrographic face is composed of a multiplicity of electrically conducting discrete elements arranged in a regular array, said voltage pattern being developed on said discrete elements.

7. In a method of electrographically forming a printable image using a electrographic plate having an imaging face closely spaced from a reference electrode, wherein relative voltages are applied to the imaging face and the electrode producing an electric field extending from the imaging face to the electrode through a developer from which a printing medium migrates in image relation to a voltage pattern which is established on said imaging face by illumination of the electrographic plate; the improvement residing in the steps of:

introducing a printing medium between the imaging face and the electrode by entrainment in the developer with a net electrostatic charge of the same polarity as the voltage applied to the imaging face to cause said migration of the printing medium under the influence of the electric field toward the reference electrode; and controlling the voltages applied to render the electric field effective to cause deposition of the printing medium on the reference electrode in image relation to the voltage pattern on the imaging face.

8. In the method as defined in claim 7, said step of controlling the voltages applied includes adjusting the voltage on the reference electrode to a level lower than that of the voltage applied to the imaging face.

9. A method of electrographically forming a printable image using an electrographic plate having a face, and an opposing electrode which is at least closely adjacent said face comprising the steps of: applying a voltage to said face; illuminating said plate with an image to induce a voltage pattern in image relation on the face of said plate; and passing a developer fluid between said face and said opposing electrode, the improvement residing in entraining a printing medium within said developer fluid, said printing medium having a net electrostatic charge of the same polarity as the voltage on said face and applying a voltage to said opposing electrode that is lower than the voltage on the face to establish an imagewise electric field from the face to said opposing electrode, said field causing imagewise migration of said printing medium from said developer fluid to said opposing electrode.

* * * * *